US012345067B2

(12) United States Patent
Drechsel et al.

(10) Patent No.: US 12,345,067 B2
(45) Date of Patent: Jul. 1, 2025

(54) SWIMMING POOL COVER SYSTEM WITH REEL DIAMETER ADJUSTMENT BLOCK AND ASSOCIATED METHODS

(71) Applicant: COVER-POOLS INCORPORATED, West Valley City, UT (US)

(72) Inventors: Lamont Drechsel, Salt Lake City, UT (US); Nathan Dewyea, Sandy, UT (US)

(73) Assignee: COVER-POOLS INCORPORATED, West Valley City, UT (US)

( * ) Notice: Subject to any disclaimer, the term of this patent is extended or adjusted under 35 U.S.C. 154(b) by 254 days.

(21) Appl. No.: 17/900,998

(22) Filed: Sep. 1, 2022

(65) Prior Publication Data

US 2023/0072636 A1 Mar. 9, 2023

Related U.S. Application Data

(60) Provisional application No. 63/240,409, filed on Sep. 3, 2021.

(51) Int. Cl.
*E04H 4/10* (2006.01)

(52) U.S. Cl.
CPC ..... *E04H 4/101* (2013.01)

(58) Field of Classification Search
CPC ..... E04H 4/10; E04H 4/101; B65H 75/00; B65H 75/14; B65H 75/2209; B65H 75/249
See application file for complete search history.

(56) References Cited

U.S. PATENT DOCUMENTS 3,747,132 A * 7/1973 Foster ..... E04H 4/101 160/310
4,686,717 A * 8/1987 MacDonald ..... E04H 4/101 4/502
4,811,433 A * 3/1989 MacDonald ..... E04H 4/101 4/502
4,815,152 A * 3/1989 MacDonald ..... E04H 4/101 4/502
2013/0212797 A1 8/2013 Drechsel et al.

OTHER PUBLICATIONS

International Application No. PCT/US2022/042297, International Search Report and Written Opinion mailed on Dec. 8, 2022, 13 pages.
International Application No. PCT/US2022/042297, International Preliminary Report on Patentability mailed on Mar. 14, 2024, 9 pages.

* cited by examiner

*Primary Examiner* — Erin Deery
(74) *Attorney, Agent, or Firm* — Kilpatrick Townsend & Stockton LLP

(57) ABSTRACT

A reel for a swimming pool cover system includes an adjustable outer diameter that may receive a rope of the swimming pool cover system. The reel also includes an adjuster that may selectively change the outer diameter of the reel. A method for controlling an outer diameter of the reel includes controlling an adjuster of the reel such that the outer diameter of the reel changes.

8 Claims, 7 Drawing Sheets

SWIMMING POOL COVER SYSTEM WITH REEL DIAMETER ADJUSTMENT BLOCK AND ASSOCIATED METHODS

REFERENCE TO RELATED APPLICATION

This application claims the benefit of U.S. Provisional Patent Application No. 63/240,409, filed on Sep. 3, 2021 and entitled SWIMMING POOL COVER SYSTEM WITH REEL DIAMETER ADJUSTMENT BLOCK AND ASSOCIATED METHODS, the content of which is hereby incorporated by reference in its entirety.

FIELD OF THE INVENTION

The field of the invention relates to systems for positioning a cover over a space, and, more particularly, to systems for positioning a cover over pools, spas, and other water containing vessels for recreation or therapy.

BACKGROUND

Pools, spas, and other water containing vessels are often covered when not in use for a number of reasons including, but not limited to, limiting evaporation of water and chemicals, retaining heat, and acting as a barrier to materials that may fail into the pool. In addition to pools, other spaces such as ponds may also be selectively covered. Traditionally, cover systems have included both manually positioned covers as well as automatic cover systems that use drive mechanisms to automatically position the cover relative to the pool or other space to be covered.

A traditional automatic cover system may include tracks along two opposite edges of the pool that guide edges of the cover, as well as ropes which are attached to opposing sides of a leading edge of the cover. The ropes extend from the leading edge around various pulleys and back to reels, which are rotated simultaneously by a motor to cause the reels to pull in the ropes to move the cover over the pool. However, if one rope stretches/shrinks, and/or if the pool shape is not square, one side of the cover will reach the end of the pool before the other side does. In such cases, the cover will stop, but the pool cover will not be completely over the pool. Dirt and debris can still enter the water and evaporation will continue to remove heat, water, and chemicals from the pool.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments, a reel for a swimming pool cover system includes an adjustable outer diameter (or other dimension) that may receive a rope of the swimming pool cover system. The reel also includes an adjuster configured to selectively change the outer diameter (or other dimension) of the reel.

According to various embodiments, a method for controlling an outer diameter (or other dimension) of a reel for a swimming pool cover system includes providing the reel, wherein the reel includes an adjustable outer diameter (or other dimension), and controlling an adjuster of the reel such that the outer diameter (or other dimension) of the reel changes.

According to certain embodiments, a reel for a cover system includes a reel body and an adjustment block supported on the reel body. The reel body and the adjustment block together define an outer diameter of the reel, and the adjustment block is pivotable relative to the reel body such that the outer diameter is adjustable.

According to various embodiments, a cover system includes a reel system having a reel. The reel includes a reel body and an adjustment block. The reel body includes a first end, a second end, a side surface extending between the first end and the second end, and a block cavity defined in the side surface. The adjustment block includes a side surface, and the side surface of the reel body and the side surface of the adjustment block together define an outer diameter of the reel. The adjustment block is pivotably supported within the block cavity such that the adjustment block is pivotable relative to the reel body and the outer diameter of the reel is adjustable.

According to various embodiments, a reel for a cover system includes a reel body having a side surface for receiving a rope of the cover system. The side surface defines a block cavity in a portion of the side surface. The reel also includes an adjustment block supported in the block cavity and having a side surface. The side surface of the reel body and the side surface of the adjustment block together define an outer diameter of the reel, and the adjustment block is movable between a stowed position and a deployed position relative to the reel body.

According to certain embodiments, a method for controlling an outer diameter of a reel for a cover system includes providing the reel, wherein the reel includes a reel body and an adjustment block supported in a block cavity of the reel body. The reel body and the adjustment block together define the outer diameter of the reel. The method includes controlling an adjustment feature of the reel such that the adjustment block pivots relative to the reel body, and the pivoting of the adjustment block changes the outer diameter of the reel.

Various implementations described herein can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The specification makes reference to the following appended figures, in which use of like reference numerals in different figures is intended to illustrate like or analogous components.

DETAILED DESCRIPTION

Described herein are cover systems for positioning a cover over a space, including but not limited to a pool, and associated methods. The cover systems provided herein include a reel system having at least one reel for selectively pulling a rope of the cover system. The reel includes an adjustable outer diameter (or other dimension) and an adjuster that can selectively change the outer diameter (or other dimension). In some embodiments, the adjuster may adjust the outer diameter of the reel between a minimum outer diameter and a maximum outer diameter. In some embodiments, the reel includes a reel body, and the adjuster includes an adjustment block. In these embodiments, the reel body and adjuster may together define an outer diameter of the reel, and the adjustment block is adjustable relative to the reel body such that the outer diameter is adjustable as desired. In some embodiments, the reel system includes more than one reel, such as two reek, each of which may have an adjustable outer diameter. In certain embodiments, the adjustable reel provided herein may allow for adjustment of the rate at which the rope is pulled up, and thus the rate at which the cover of the cover system advances (or vice versa, adjustment of the rate at which the rope is let out). In embodiments with more than one reel, each reel may be independently adjusted such that the rate at which each side of the cover advances can be independently adjusted.

In various embodiments, the adjustable reel may allow for adjustment of the outer diameter of the reel while minimizing potential damage to the rope by optionally encasing an adjuster for the reel in the adjustment block. In some embodiments, the adjustable reel may be stable to support a load placed across the diameter of the adjustment block. The adjustment block of the reel may also be stable and able to support non-symmetric loads along a length of the adjustment block. In some cases, a single adjuster optionally may be used to control a position of the adjustment block relative to the reel body. Various other improvements and advantages may be realized with the reel described herein, and the aforementioned benefits should not be considered limiting on the disclosure.

Figure 1:
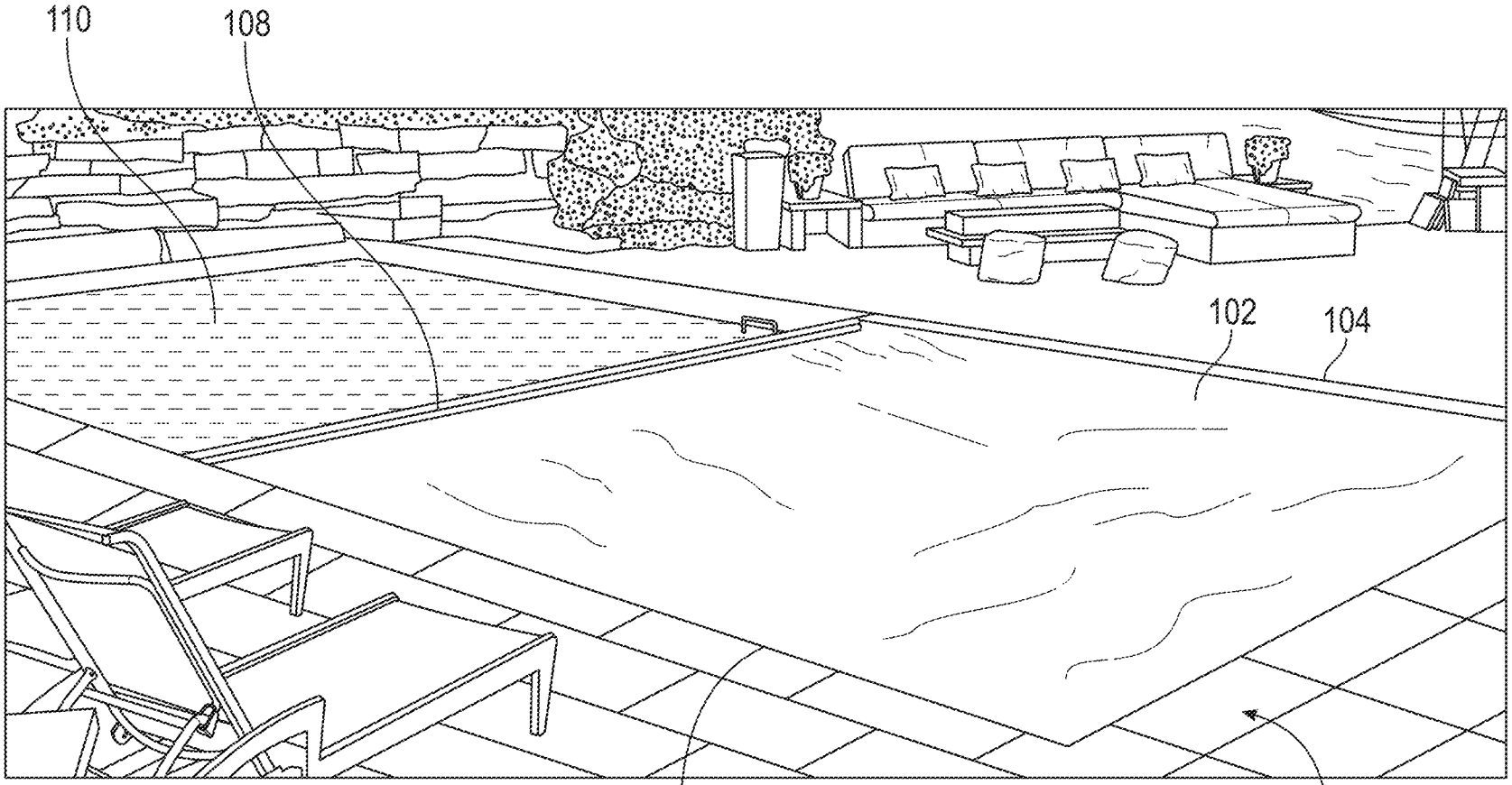
FIG. 1 illustrates a cover system according to certain embodiments.

Referring to FIG. 1, a cover system 100 generally includes a cover 102, a first track 104, and a second track 106, The cover 102 includes a leading edge 108, and opposing sides of the leading edge 108 may be received in the tracks 104, 106, respectively. The cover system 100 may include additional features including but not limited to ropes for the opposing sides of the leading edge 108, guides, drums, reels, support mechanisms, drive means, and/or other features as desired. The cover system 100 is operable to position the cover 102 between a stowed position, in which the cover 102 substantially uncovers a space, and a deployed position, in which the cover 102 is positioned over a space to be covered. As mentioned, the space to be covered may be any area that a user may desire to cover or uncover. In the embodiment of FIG. 1, the space to be covered is a swimming pool 110, and the cover 102 is illustrated in a partially deployed position. The particular cover system 100 illustrated in FIG. 1 should not be considered limiting, and a cover system may include additional and/or fewer features or components as desired. Similarly, the swimming pool 110 illustrated in FIG. 1 should not be considered limiting, and in other embodiments the swimming pool may have other shapes, sizes, and/or features as desired.

Figure 2:
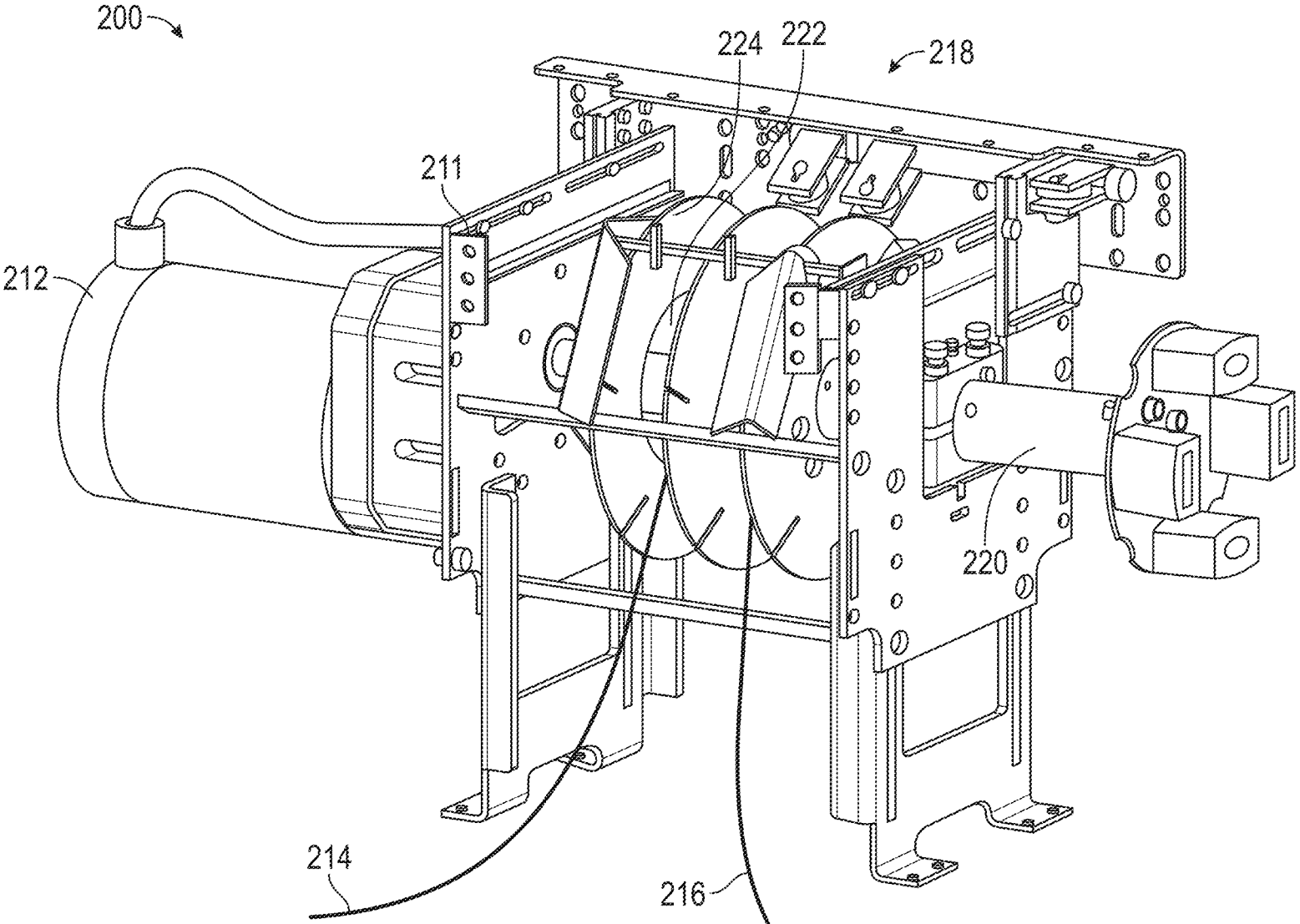
FIG. 2 illustrates a cover system including a reel system according to embodiments.
Figure 3:
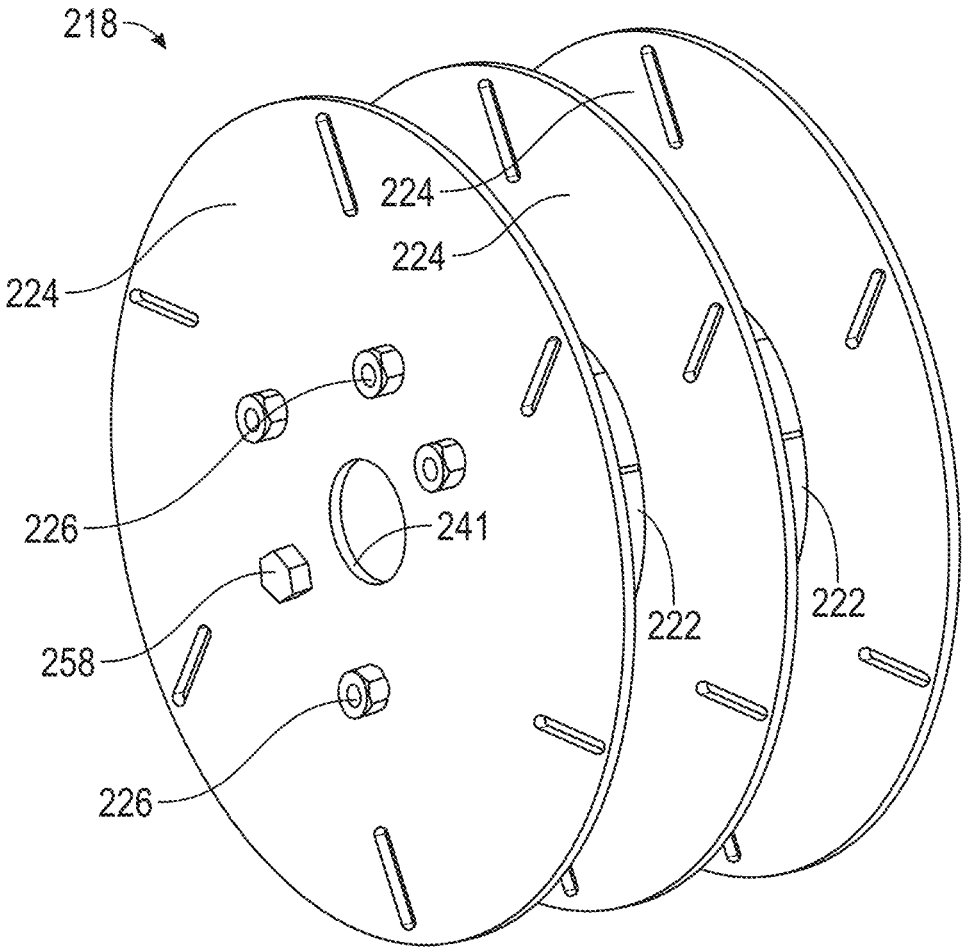
FIG. 3 is a perspective view of the reel system of FIG. 2.
Figure 4:
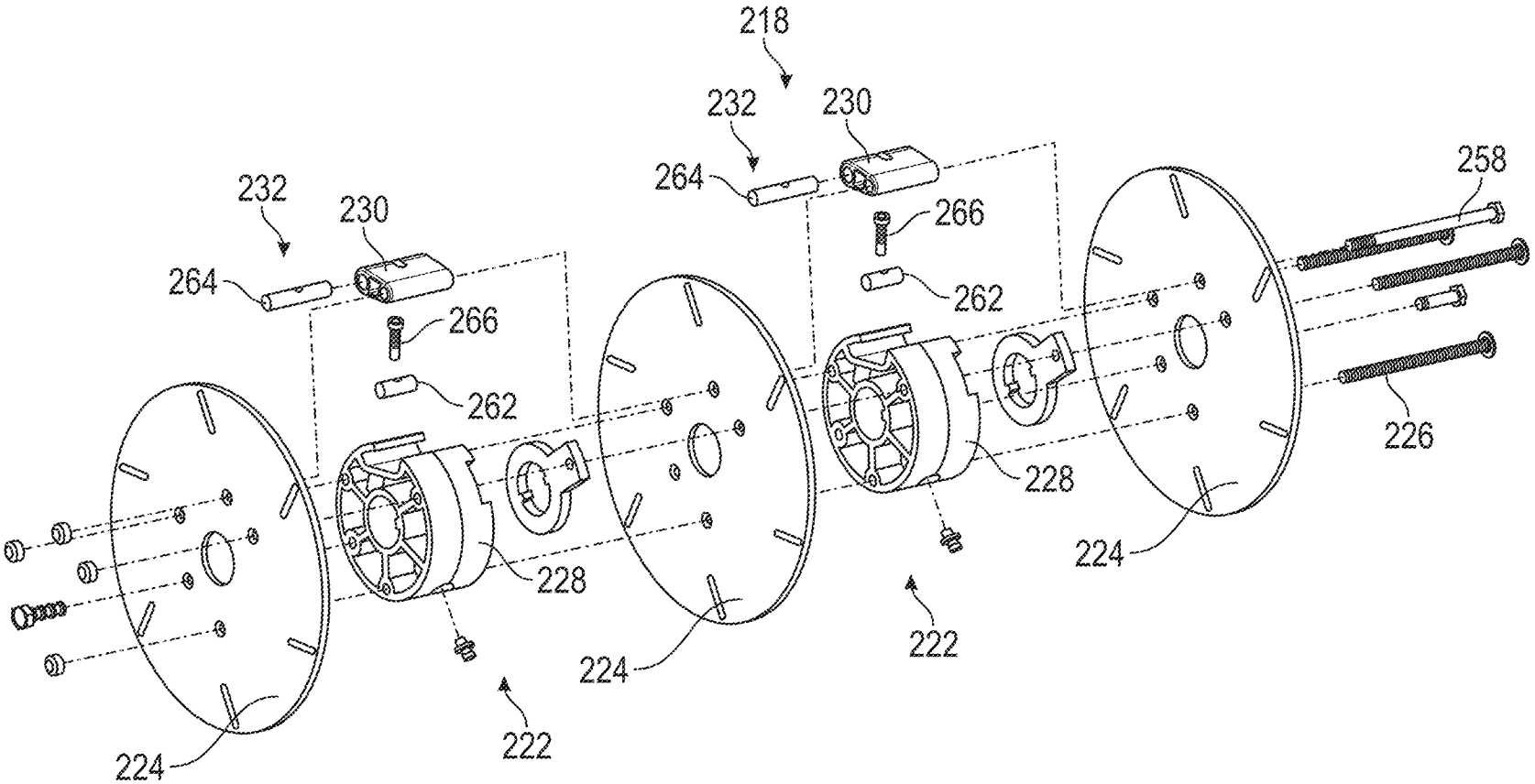
FIG. 4 is an exploded view of the reel system of FIG. 2.

FIG. 2 illustrates a portion of another cover system 200 according to various embodiments. The cover system 200 may include a cover similar to the cover 102 and optionally include features similar to those illustrated in FIG. 1. As illustrated in FIG. 2, the cover system 200 includes a support 211, a drive means 212, a first rope 214 connectable to a leading edge of the cover, a second rope 216 connectable to the leading edge of the cover, and a reel system 218. The reel system 218 is supported on a shaft 220 that is rotatable by the drive means 212, and rotation of the shaft 220 may allow for the ropes 214, 216 to be selectively pulled in or let out by the reel system 218 to allow the cover to be stowed or deployed as desired. The drive means 212 may be various suitable devices or mechanisms for rotating the shaft 220, and in the embodiment of FIG. 2, the drive means 212 is an electric motor.

Referring to FIGS. 3-11, the reel system 218 includes at least one reel 222. In various embodiments, an outer diameter 221 of the reel 222 is adjustable, and the reel 222 may include an adjuster that selectively changes the outer diameter 221 as desired. In some cases, the adjuster may optionally adjust the outer diameter 221 between a maximum outer diameter and a minimum outer diameter. The adjuster may be various devices or components as desired for selectively changing the outer diameter 221 of the reel 222. In the embodiment illustrated in FIGS. 3-11 the adjuster is an adjustment block 230; however, the adjustment block 230 should not be considered limiting, and other types of adjusters may be used as desired. Moreover, the features of the reel 222 illustrated in FIGS. 3-11 for the adjustment block 230 (e.g., a block cavity) need not be included, and/or the reel 222 may include other features as desired depending on the type of adjuster.

In various embodiments, the reel system 218 includes the at least one reel 222 and at least one reel plate 224. In the embodiment illustrated, the reel system 218 includes two reels 222 and three reel plates 224, and each reel 222 is positioned between adjacent reel plates 224. In certain embodiments, the reel plates 224 have an outer diameter that is greater than an outer diameter of the reels 222, and the reel plates 224 may be used to facilitate positioning of the ropes on the reels 222. The reels 222 and the reel plates 224 may be connected using various fastening mechanisms 226 as desired. In the embodiment illustrated the fastening mechanisms 226 include threaded fasteners.

Figure 10:
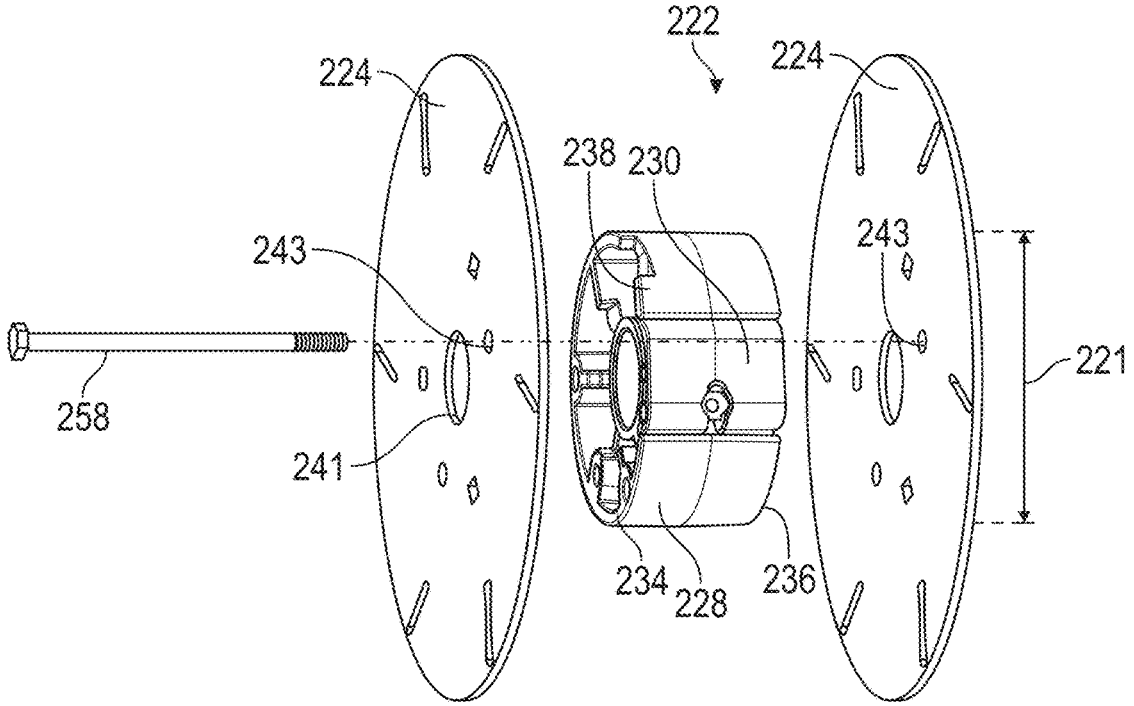
FIG. 10 is a perspective view of a portion of the reel system of FIG. 2.

In some embodiments, and as illustrated in FIG. 10, each reel plate 224 includes a pivot aperture 243 for receiving a pivot pin 258 that connects the reel plates 224 to the adjustment block 230 of the reel 222 to position the adjustment block 230 relative to a reel body 228 of the reel 222 and allow for the adjustment block 230 to pivot relative to the reel body 228 (e.g., by pivoting on the pivot pin 238). The number of reels 222, reel plates 224, and/or fastening mechanisms 226 should not be considered limiting.

Each reel 222 includes the reel body 228 and the adjustment block 230 supported on the reel body 228. The reel body 228 and the adjustment block 230 together define the outer diameter 221 of the reel 222 (see FIG. 10). As discussed in detail below, the adjustment block 230 is adjustable relative to the reel body 228 such that the outer diameter 221 of the reel 222 is adjustable as desired (see, e.g., FIG. 11). In some embodiments, and as discussed in detail below, the reel 222 may include an adjustment system 232 for adjusting the position of the adjustment block 230 relative to the reel body 228.

Figure 6:
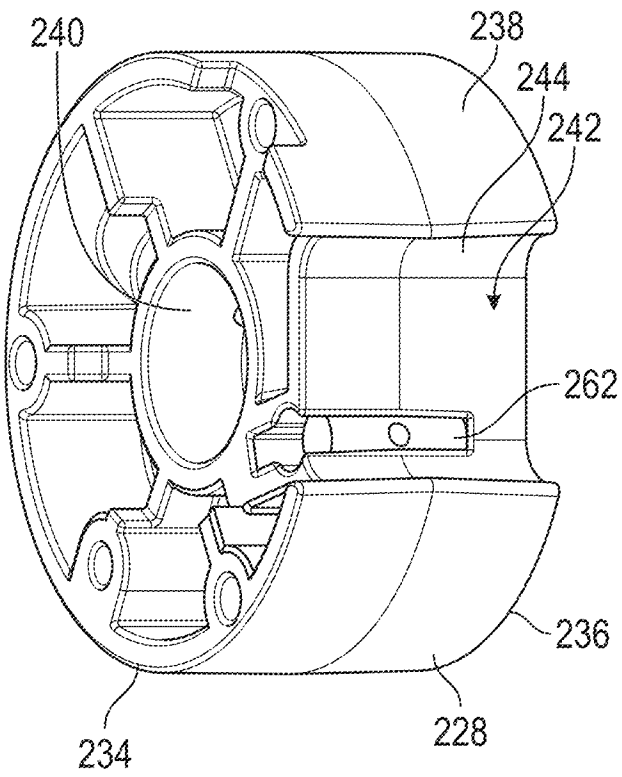
FIG. 6 is another perspective view of the reel body of FIG. 5.
Figure 5:
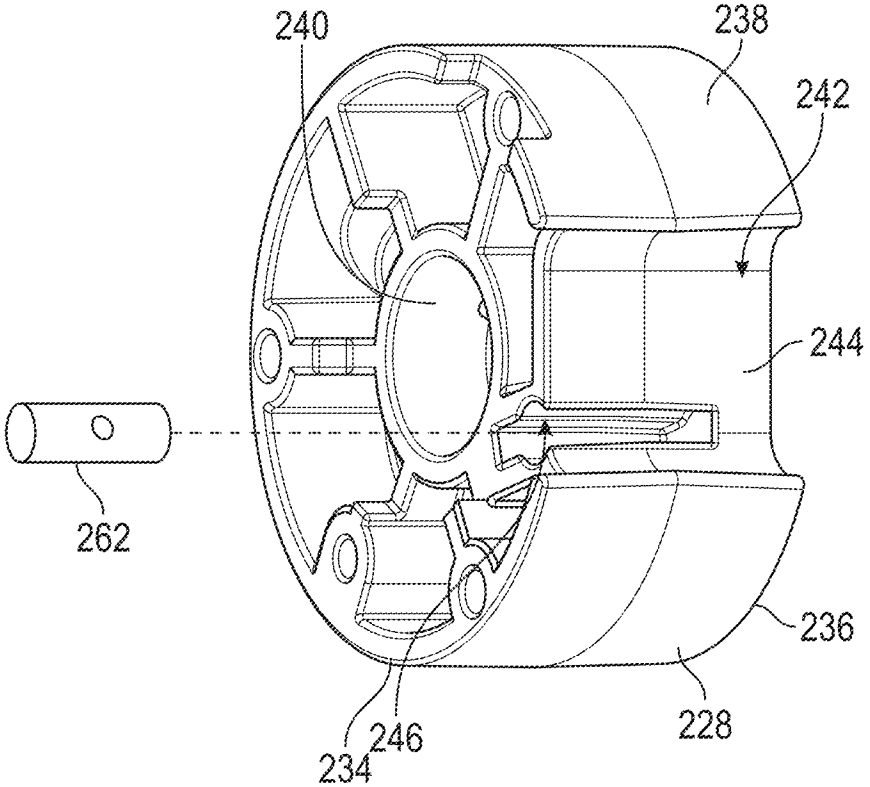
FIG. 5 is a perspective view of a reel body of a reel of the reel system of FIG. 2.

As best illustrated in FIGS. 5 and 6, the reel body 228 includes a first end 234, a second end 236, and a side surface 238 extending from the first end 234 to the second end 236. The reel body 228 also includes an aperture 240 for receiving the shaft 220 when the cover system 200 is assembled. The aperture 240 may be aligned with an aperture 241 of the reel plates 224 when the reel system 218 is assembled. The side surface 238 of the reel body 228 at least partially defines the outer diameter of the reel 222 and is a surface that may receive a rope (e.g., the first rope 214 or the second rope 216) of the cover system 200. The reel body 228 may be constructed from various materials or combinations of materials as desired. In the embodiment illustrated, the reel body 228 is constructed from a plastic material.

In some embodiments, and as illustrated in FIGS. 5 and 6, the side surface 238 defines a block cavity 242 for receiving the adjustment block 230 in a portion of the side surface 238. The block cavity 242 may extend from the first end 234 to the second end 236 and includes a cavity surface 244. In certain embodiments, the cavity surface 244 may be complimentary to a shape of the adjustment block 230 such that the adjustment block 230 can be flush with the side surface 238 when the adjustment block 230 is in a stowed position (discussed below). In various embodiments, the reel body 228 may further define a support cavity 246 within the block cavity 242. As discussed in detail below, the support cavity 246 may receive a first adjustment support 262 of the adjustment system 232. In certain embodiments in addition to being defined in the cavity surface 244 of the block cavity 242, the support cavity 246 may extend from the first end 234 to a position between the first end 234 and the second end 236 of the reel body 228. Stated differently, in various embodiments, a length of the support cavity 246 may be less than a length of the block cavity 242.

Figure 9:
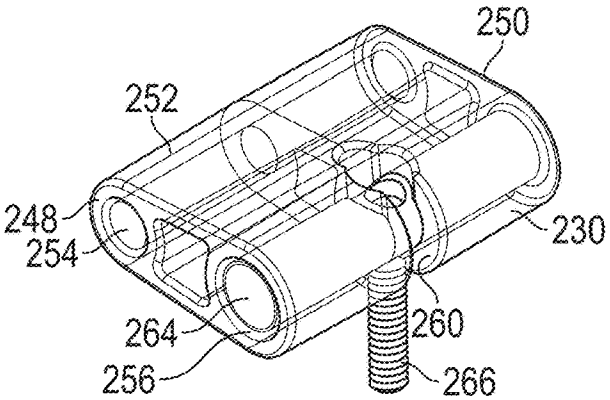
FIG. 9 is another perspective view of the adjustment block of FIG. 7.
Figure 8:
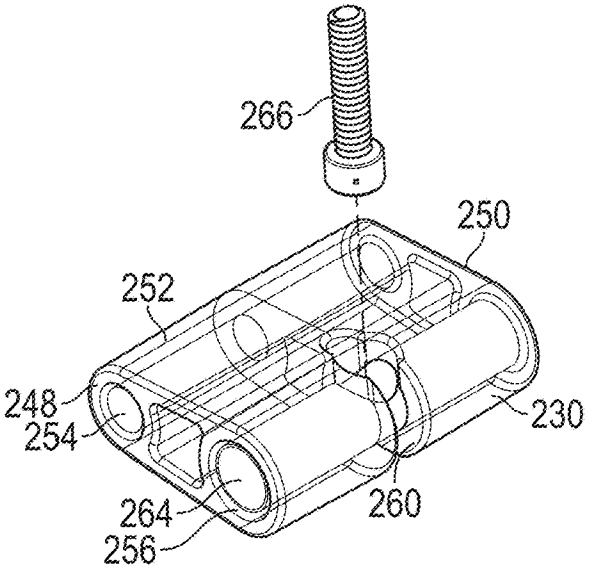
FIG. 8 is another perspective view of the adjustment block of FIG. 7.
Figure 7:
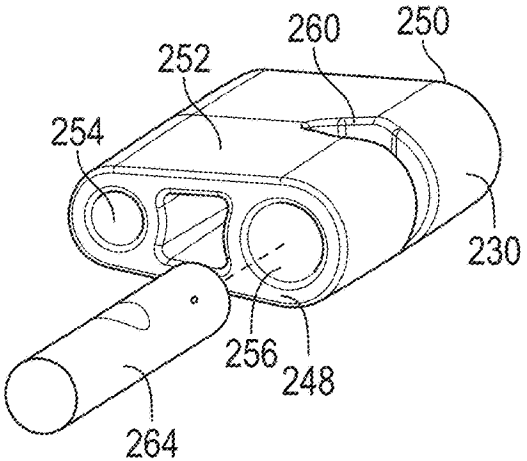
FIG. 7 is a perspective view of an adjustment block of the reel of the reel system of FIG. 2.

As best illustrated in FIGS. 7-9, the adjustment block 230 of the reel 222 includes a first end 248, a second end 250, and a side surface 252 extending from the first end 248 to the second end 250. In certain embodiments, when the adjustment block 230 is assembled with the reel body 228, at least a portion of the side surface 252 defines a portion of the outer diameter of the reel 222, and the adjustment block 230 and the reel body 228 together define the outer diameter of the reel 222. The adjustment block 230 may be constructed from various materials as desired, and in the embodiment illustrated, the adjustment block 230 is constructed from the same plastic material as the reel body 228, although it need not be.

In some embodiments, a distance from the first end 248 to the second end 250 is the same as the distance from the first end 234 to the second end 236 of the reel body 228 such that the length of the adjustment block 230 is the same as the length of the reel body 228. In other embodiments, the lengths need not be the same.

As best illustrated in FIGS. 7-9, in certain embodiments, the adjustment block 230 includes a pivot aperture 254 and a support aperture 256. The pivot aperture 254 may receive the pivot pin 258 for the adjustment block 230 (see, e.g., FIGS. 10 and 11), and the support aperture 256 may receive a second adjustment support 264 of the adjustment system 232. In certain aspects, the adjustment block 230 includes an adjustment slot 260 that may receive an adjuster 266 of the adjustment system 232. In various examples, the adjustment slot 260 may extend transversely to the support aperture 256, and in certain aspects, the adjustment slot 260 intersects the support aperture 256. In some cases, the adjustment slot 260 may receive the adjuster 266 and may optionally allow for rotation of the adjuster 266 relative to the adjustment block 230. As an example, FIG. 8 illustrates the adjuster 266 being positioned relative to the adjustment slot 260, and FIG. 9 illustrates the adjuster 266 rotated 180 degrees while being retained within the adjustment slot 260. In such embodiments, the rotation of the adjuster 266 may lock the adjuster 266 in place relative to the adjustment block 230.

Figure 11:
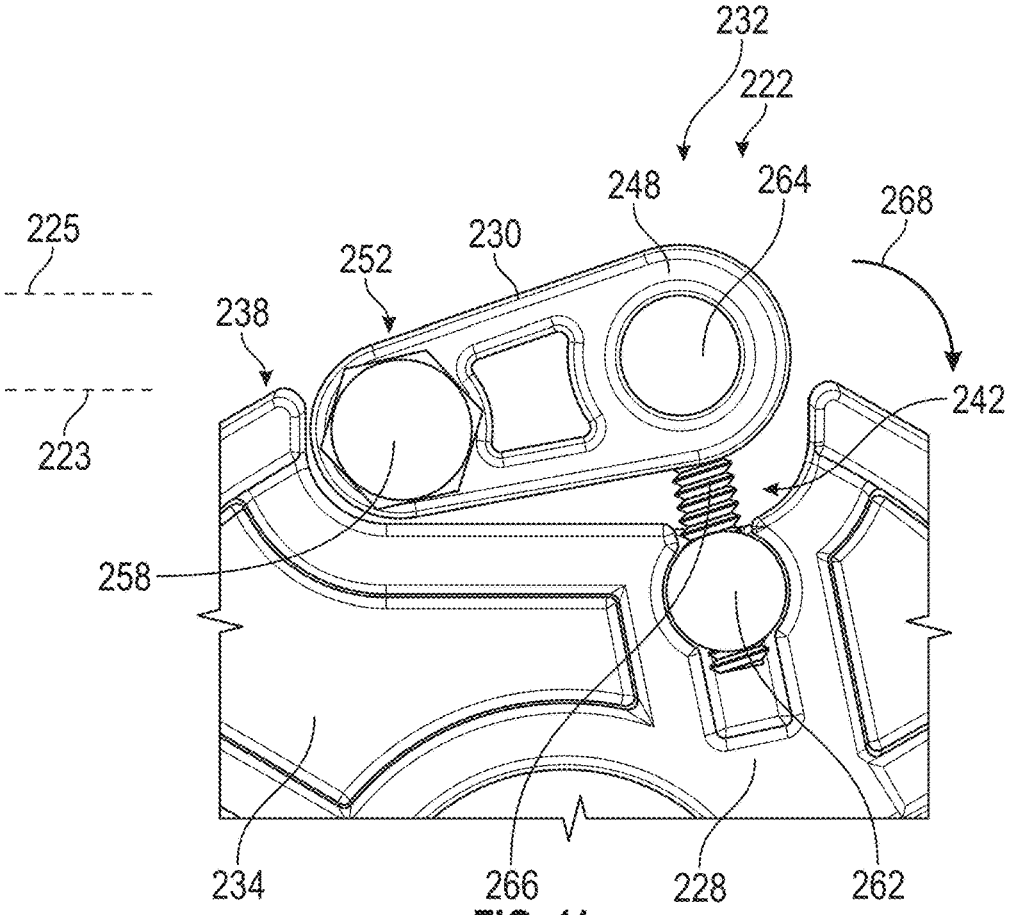
FIG. 11 illustrates a portion of the reel of the reel system of FIG. 2.

Referring to FIG. 10, when the adjustment block 230 is assembled with the reel body 228 to form the reel 222, the adjustment block 230 may be positioned within the block cavity 242. Reel plates 224 may be supported proximate to the first end 234 and the second end 236 of the reel body 228, and the fastening mechanisms 226 (not shown in FIG. 10) may connect the reel body 228 to the reel plates 224. As illustrated in FIGS. 10 and 11, the pivot pin 258 may support the adjustment block 230 and may be connected to the reel plates 224. Such a connection may support the adjustment block 230 relative to the reel body 228 and may also allow for the adjustment block 230 to move relative to the reel body 228 (e.g., by pivoting about the pivot pin 258). In such embodiments, the adjustment block 230 may not be directly connected to the reel body 228 (e.g., the adjustment block 230 is connected to the reel plates 224 via the pivot pin 258, and the reel plates 224 in turn are connected to the reel body 228).

As mentioned, in various embodiments, the reel 222 includes the adjustment system 232 for adjusting the position of the adjustment block 230 relative to the reel body 228. In certain embodiments, the adjustment system 232 may allow for movement of the adjustment block 230 between a stowed position and a deployed position.

FIG. 11 illustrates the adjustment block 230 in the deployed position. In the deployed position, and as illustrated in FIG. 11, at least a portion of the adjustment block 230 is outside (e.g., not within) the block cavity 242. Optionally, the adjustment block 230 in the deployed position may be angled outwards compared to the orientation of the adjustment block 230 in the stowed position. In various embodiments, in the stowed position, the adjustment block 230 and the reel body 228 define a minimum outer diameter for the reel 222 (represented by line 223 in FIG. 11), and, in the deployed position, the adjustment block 230 and the reel body 228 define a maximum outer diameter for the reel 222 (represented by line 225 in FIG. 11). When the reel system 218 includes a plurality of reels 222, the position of the adjustment block 230 for one reel 222 may be the same as or different from the position of the adjustment block 230 for another reel 222.

Arrow 268 in FIG. 11 represents movement of the adjustment block 230 from the deployed position to the stowed position. In the stowed position, the adjustment block 230 may be substantially positioned within the block cavity 242.

Optionally, in the stowed position, an outermost portion of the side surface 252 of the adjustment block 230 may be substantially flush with the side surface 238 of the reel body 228.

Various suitable devices and mechanisms may be used as the adjustment system 232. In certain embodiments, the adjustment system 232 optionally includes the first adjustment support 262 supported on the reel body 228, the second adjustment support 264 supported on the adjustment block 230, and the adjuster 266 connecting the first adjustment support 262 and the second adjustment support 264. In the embodiment of FIGS. 2-11, the first adjustment support 262 is a dowel pin that is retained within the support cavity 246 of the reel body 228, the second adjustment support 264 is a dowel pin that is retained within the support aperture 256 of the adjustment block 230, and the adjuster 266 is a threaded fastener that is at least partially positioned within the adjustment slot 260 and that threadably engages the first adjustment support 262 and the second adjustment support 264. When assembled, the adjuster 266 engages both of the adjustment supports 262, 264, and the adjuster 266 is rotatable while engaged with the adjustment supports 262, 264. Rotation of the adjuster 266 in these embodiments will thus either draw the adjustment supports 262, 264 together (and thus the adjustment block 230 and reel body 228 together towards the stowed configuration) or move the adjustment supports 262, 264 apart from each other (and thus the adjustment block 230 and the reel body 228 apart towards the deployed configuration). In certain aspects, the pivot pin 258 connecting the adjustment block 230 with the reel plates 224 may maintain a positioning of one side of the adjustment block 230 relative to the reel body 228 as the adjuster 266 is rotated while allowing for movement of the opposing side. In other words, in these embodiments, rotating of the adjuster 266 causes the adjustment block 230 to pivot about the pivot pin 258 relative to the reel body 228. In other embodiments, other suitable types of adjustment systems 232 for controlling the position of the adjustment block 230 relative to the reel body 228 may be used as desired.

Referring back to FIG. 4, a method of assembling the reel system 218 is described below. In certain embodiments, assembling the reel system 218 may include positioning the first adjustment support 262 in the support cavity 246 of the reel body 228 and positioning the second adjustment support 264 in the support aperture 256 of the adjustment block 230. The method may include positioning the adjuster 266 relative to the adjustment slot 260 of the adjustment block 230 and such that the adjuster 266 at least partially engages the second adjustment support 264.

The method may include positioning the adjustment block 230 at least partially within the block cavity 242. In certain embodiments, positioning the adjustment block 230 at least partially within the block cavity 242 includes positioning the adjustment block 230 such that the second adjustment support 264 on the adjustment block 230 is proximate to the first adjustment support 262 on the reel body 223. Optionally, positioning, the adjustment block 230 at least partially within the block cavity 242 may include engaging the adjuster 266 with the first adjustment support 262 such that the adjuster 266 is engaged with both the first adjustment support 262 and the second adjustment support 264. However, in other embodiments, the adjuster 266 may engage the first adjustment support 262 at other stages, such as after the assembly of the reel plates 224 discussed below. In certain embodiments, positioning the adjustment block 230 at least partially within the block cavity 242 includes positioning at least the portion of the adjustment block 230 having the pivot aperture 254 within the block cavity 242.

In various embodiments, after the adjustment block 230 is positioned at least partially within the block cavity 242, the method includes positioning the reel plates 224 adjacent to the ends 234, 236 of the reel body 228. Positioning the reel plates 224 may include aligning the aperture 240 of the reel body 228 with the apertures 241 of the reel plates 224 (e.g., such that the shaft 220 can eventually be inserted through the reel plates 224 and the reel 222). Positioning the reel plates 224 relative to the reel body 228 may include securing the reel plates 224 to the reel body 228 using the fastening mechanisms 226. In various embodiments, positioning the reel plates 224 includes aligning the pivot apertures 243 of the reel plates 224 with the pivot aperture 254 of the adjustment block 230, and inserting the pivot pin 258 through the aligned pivot apertures 243, 254 (see, e.g., FIG. 10). Inserting the pivot pin 258 through the aligned pivot apertures 243, 254 may connect the reel plates 224 to the adjustment block 230 and retains the adjustment block 230 at least partially within the block cavity 242 (see, e.g., FIG. 11) while allowing for the adjustment block 230 to pivot relative to the reel body 228 (e.g., by pivoting on the pivot pin 258 via rotation of the adjuster 266).

Once assembled, the outer diameter 221 may be controlled such that the reel 222 has a desired outer diameter 221. In some embodiments, a method of controlling the outer diameter 221 of the reel 222 includes rotating the adjuster 266 (e.g., clockwise or counter-clockwise) to cause the adjustment block 230 to pivot about the pivot pin 258 and relative to the reel body 228. In one non-limiting example, a clockwise rotation of the adjuster 266 may draw the adjustment supports 262, 264 together, which in turn may draw the adjustment block 230 towards the block cavity 242 and towards the minimum outer diameter 223. In this example, a counter-clockwise rotation of the adjuster 266 may move the adjustment supports 262, 264 away from each other, which in turn pushes the side of the adjustment block 230 opposite from the pivot pin 258 away from the reel body 228 and towards the maximum outer diameter 225. The rotation of the adjuster 266 may thus move the adjustment block 230 to the stowed position, the deployed position, or any position therebetween relative to the reel body 228, thus controlling the outer diameter 221 as desired. Moreover, when the reel system 216 includes a plurality of reek 222, the outer diameter 221 of each reel 222 may be controlled as desired.

In various embodiments, adjustment of the outer diameter 221 of the reels 222 may allow for the cover system 200 to be controlled such that the opposing sides of the leading edge of the cover reach the end of the pool at the same time, which in turn may help minimize dirt or other debris from entering the pool and/or help minimize heat, water, and chemicals from evaporating if the pool were not properly covered.

As a non-limiting example, and referring to FIG. 2, the first rope 214 may be connected to a left side of the leading edge of a cover and the second rope 216 may be connected to a right side of the leading edge of the cover, and a length of the first rope 214 is different from the length of the second rope 216. For example, the first rope 214 may have shrunk in length compared to the second rope 216. In this example, without the reel 222 having the adjustable outer diameter, the left side of the leading edge of the cover will reach the end of the pool before the right side of the leading edge of the cover, which will (i) stop further movement of the cover and (ii) leave a portion of the pool proximate to the right side uncovered. However, with the reel system 218 provided herein, the outer diameter of the reel 222 for the second rope 216 can be increased (and/or the outer diameter of the reel 222 for the first rope 214 can be decreased) such that more of the second rope 216 is taken up per a revolution of the reel 222 compared to the first rope 214. In this example, after the adjustment of the outer diameters of the reels 222 with the reel system 218, the opposing sides of the leading edge of the cover may move at rates such that they reach the end of the pool at the same time even though the lengths of the ropes 214, 216 are not the same.

Using this same example, if the shorter first rope 214 is replaced with a new rope having the correct (e.g., same) length as the second rope 216, the reel 222 for the new rope no longer needs to have the increased diameter because it would otherwise cause the leading edge to advance at different speeds or rates. In this example, the reel 222 could be adjusted by reducing its outer diameter to allow for the new rope to be pulled at the desired rate, optionally to be the same of the second rope 216. As illustrated by these examples, the reel 222 with the adjustment block 230 may allow for a quick adjustment of the reek 222 such that the ropes of the cover system are moved at the desired rate, thereby minimizing or preventing improper movement and/or positioning of the leading edge of the cover.

In other embodiments, the ropes 214, 216 may originate and/or be provided on reels that are located on one side of the pool, and one rope has to run the width of the pool to reach a track (e.g., track 104) while the other rope is already next to the other track (e.g., track 106). In such embodiments, the adjustable reel 222 may still allow for control of the ropes 214, 216 as desired such that the ropes are moved at a desired rate, thereby minimizing or preventing improper movement and/or positioning of the cover.

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. A reel for a swimming pool cover system, the reel comprising a reel body and an adjustment block supported on the reel body, wherein the reel body and the adjustment block together define an outer diameter of the reel, and wherein the adjustment block is pivotable relative to the reel body such that the outer diameter is adjustable.

Illustration 2. The reel of any preceding or subsequent illustrations or combinations of illustrations, wherein the reel body comprises a side surface defining a block cavity, and wherein the adjustment block is supported on the reel body within the block cavity.

Illustration 3. The reel of any preceding or subsequent illustrations or combinations of illustrations, wherein the adjustment block is adjustable between a stowed position and a deployed position, wherein, in the stowed position, the adjustment block is retained within the block cavity, and wherein, in the deployed position, at least a portion a the adjustment block is outside the block cavity.

Illustration 4. The reel of any preceding or subsequent illustrations or combinations of illustrations, further comprising an adjustment system configured to control a position of the adjustment block relative to the reel body, wherein the adjustment system comprises a first adjustment support supported on the reel body, a second adjustment support supported on the adjustment block, and an adjuster engaged with the first adjustment support and the second adjustment support.

Illustration 5. A reel system comprising: the reel of any preceding or subsequent illustrations or combinations of illustrations; a first reel plate; and a second reel plate, wherein the first reel plate and the second reel plate each comprise an outer diameter that is greater than the outer diameter of the reel, and wherein the reel is positioned between the first reel plate and the second reel plate.

Illustration 6. The reel system of any preceding or subsequent illustrations or combinations of illustrations, further comprising a pivot pin connecting the first reel plate, the adjustment block, and the second reel plate, and wherein the adjustment block is pivotally supported on the pivot pin.

Illustration 7. A cover system comprising the reel of any preceding or subsequent illustrations or combinations of illustrations.

Illustration 8. The cover system of any preceding or subsequent illustrations or combinations of illustrations, wherein the cover system is an automatic pool cover system.

Illustration 9. A cover system for a swimming pool, the cover system comprising a reel system, the reel system comprising a reel, the reel comprising: a reel body comprising a first end, a second end, a side surface extending between the first end and the second end, and a block cavity defined in the side surface; and an adjustment block comprising a side surface, wherein the side surface of the reel body and the side surface of the adjustment block together define an outer diameter of the reel, and wherein the adjustment block is pivotably supported within the block cavity such that the adjustment block is pivotable relative to the reel body and the outer diameter of the reel is adjustable.

Illustration 10. The cover system of any preceding or subsequent illustrations or combinations of illustrations, wherein the reel system further comprises: a first reel plate connected to the first end of the reel body; and a second reel plate connected to the second end of the reel body, wherein the first reel plate and the second reel plate each comprise an outer diameter that is greater than the outer diameter of the reel.

Illustration 11. The cover system of any preceding or subsequent illustrations or combinations of illustrations, wherein the reel system further comprises a pivot pin connecting the first reel plate, the adjustment block, and the second reel plate, and Wherein the adjustment block is pivotably supported on the pivot pin.

Illustration 12. The cover system of any preceding or subsequent illustrations or combinations of illustrations, wherein the side surface of the reel body further defines a support cavity within the block cavity, and wherein the reel further comprises an adjustment support retained within the support cavity.

Illustration 13. The cover system of any preceding or subsequent illustrations or combinations of illustrations, wherein the block cavity extends from the first end to the second end of the reel body, and wherein the support cavity extends from the first end to an intermediate position between the first end and the second end of the reel body.

Illustration 14. The cover system of any preceding or subsequent illustrations or combinations of illustrations, wherein the adjustment block further comprises a first end and a second end, wherein the side surface of the adjustment block extends from the first end to the second end of the adjustment block, and Wherein the adjustment block further comprises a pivot aperture configured to receive a pivot pin and a support aperture configured to receive an adjustment support.

Illustration 15. The cover system of any preceding or subsequent illustrations or combinations of illustrations, wherein the reel further comprises an adjustment system configured to control a position of the adjustment block relative to the reel body, wherein the adjustment system comprises a first adjustment support supported on the reel body, a second adjustment support supported on the adjustment block, and an adjuster threadably engaged with the first adjustment support and the second adjustment support.

Illustration 16. The cover system of any preceding or subsequent illustrations or combinations of illustrations, further comprising: a pool cover comprising a leading edge; and a rope extending from the leading edge to the reel, wherein the reel is configured to receive the rope on the outer diameter of the reel.

Illustration 17. The cover system of any preceding or subsequent illustrations or combinations of illustrations, wherein the adjustment block is movable between a stowed position and a deployed position relative to the reel body, wherein, in the stowed position, the adjustment block causes the rope of the cover system to move at a first rate per revolution of the reel, and wherein, in the deployed position, the adjustment block causes the rope of the cover system to move at a second rate per revolution of the reel that is greater than the first rate.

Illustration 18. A reel for a cover system, the reel comprising: a reel body comprising a side surface configured to receive a rope of the cover system, the side surface defining a block cavity in a portion of the side surface; and an adjustment block supported in the block cavity and comprising a side surface, wherein the side surface of the reel body and the side surface of the adjustment block together define an outer diameter of the reel, and wherein the adjustment block is movable between a stowed position and a deployed position relative to the reel body.

Illustration 19. The reel of any preceding or subsequent illustrations or combinations of illustrations, wherein, in the stowed position, the adjustment block and the reel body define a minimum outer diameter, and wherein, in the deployed position, the adjustment block and the reel body define a maximum outer diameter.

Illustration 20. The reel of any preceding or subsequent illustrations or combinations of illustrations, wherein, in the stowed position, the adjustment block is retained within the block cavity, and wherein, in the deployed position, at least a portion of the adjustment block is outside the block cavity.

Illustration 21. The reel of any preceding or subsequent illustrations or combinations of illustrations, further comprising an adjustment system configured to control a position of the adjustment block relative to the reel body between the stowed position and the deployed position, wherein the adjustment system comprises a first adjustment support supported on the reel body, a second adjustment support supported on the adjustment block, and an adjuster engaged with the first adjustment support and the second adjustment support.

Illustration 22. The reel of any preceding or subsequent illustrations or combinations of illustrations, wherein the adjuster is threadably engaged with the first adjustment support and the second adjustment support such that rotation of the adjuster pivots the adjustment block relative to the reel body.

Illustration 23. The reel of any preceding or subsequent illustrations or combinations of illustrations, wherein the reel body comprises a first end and a second end, and wherein the block cavity extends from the first end to the second end.

Illustration 24. The reel of any preceding or subsequent illustrations or combinations of illustrations, wherein the adjustment block comprises a, first end and a second end, and wherein the adjustment block is supported in the block cavity such that the first end of the adjustment block is aligned with the first end of the reel body and the second end of the adjustment block is aligned with the second end of the reel body.

Illustration 25. The reel of any preceding or subsequent illustrations or combinations of illustrations, wherein, in the stowed position, the adjustment block causes a rope of the cover system to move at a first rate per revolution of the reel, and wherein, in the deployed position, the adjustment block causes the rope of the cover system to move at a second rate per revolution of the reel that is different than the first rate.

Illustration 26. The reel system of any preceding or subsequent illustrations or combinations of illustrations, wherein the first rate is greater than the second rate.

Illustration 27. A method for controlling an outer diameter of a reel for a cover system, the method comprising: receiving the reel comprising a reel body and an adjustment block supported in a block cavity of the reel body, wherein the reel body and the adjustment block together define the outer diameter of the reel; and controlling an adjustment feature of the reel such that the adjustment block pivots relative to the reel body, wherein the pivoting of the adjustment block changes the outer diameter of the reel.

Illustration 28. A reel for a swimming pool cover system, the reel comprising an adjustable outer diameter configured to receive a rope of the swimming pool cover system and an adjuster configured to selectively change the outer diameter of the reel.

Illustration 29. The reel of any preceding or subsequent illustrations or combinations of illustrations, wherein the adjuster is configured to adjust the outer diameter between a minimum outer diameter and a maximum outer diameter.

Illustration 30. The reel of any preceding or subsequent illustrations or combinations of illustrations, wherein the adjuster comprises an adjustment block on the reel that is movable relative to the reel.

Illustration 31. A method for controlling an outer diameter of a reel for a swimming pool cover system, the method comprising: receiving the reel comprising an adjustable outer diameter, wherein the reel is configured to receive a rope of the cover system on the outer diameter; and controlling an adjuster of the reel such that the outer diameter of the reel changes.

Illustration 32. The method of any preceding or subsequent illustrations or combinations of illustrations, wherein controlling the adjuster comprises changing the outer diameter between a minimum outer diameter and a maximum outer diameter.

Illustration 33. The method of any preceding or subsequent illustrations or combinations of illustrations, wherein controlling the adjuster comprises controlling an adjustment block on the reel that is movable relative to the reel.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. Directional or spatial references such as "up" "down," "top," "bottom," "left," "right,"

"front," and "back," among others, are intended to refer to the orientation as illustrated and described in the figure (or figures) to which the components and directions are referencing. This description should not be interpreted as implying any particular order or arrangement among or between various steps or elements except when the order of individual steps or arrangement of elements is explicitly described. References to "pools" and "swimming pools" herein may also refer to spas or other water containing vessels such as ponds and water features. References to "rope" herein are not intended to require any particular materials and may refer to natural materials, artificial materials, non-metallic materials, metallic materials, and/or other suitable materials as desired, "Rope" is also not intended to require a particular structure or construction and may also refer to various structures as desired including various cords, cables, lines, wires, strings, etc. As used herein, an "outer diameter" is not intended to infer a particular shape of the reel, but instead refers to a transverse dimension or the dimension across the widest portion of the component; thus, the transverse dimension may depend on a shape of the component. A diameter of an object is an example of a transverse dimension. As such, while the description below references diameters, the shape of the reels and other components of the cover systems is not considered limiting on the current disclosure.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A reel for a swimming pool cover system, the reel comprising an adjustable outer diameter configured to receive a rope of the swimming pool cover system and an adjuster configured to selectively change the outer diameter of the reel, wherein the reel comprises a reel body and an adjustment block supported on the reel body, wherein the adjustment block is the adjuster, wherein the reel body and the adjustment block together define the outer diameter of the reel, and wherein the adjustment block is pivotable relative to the reel body such that the outer diameter is adjustable.

2. The reel of claim 1, wherein the adjuster is configured to adjust the outer diameter between a minimum outer diameter and a maximum outer diameter.

3. The reel of claim 1, wherein the reel body comprises a side surface defining a block cavity, and wherein the adjustment block is supported on the reel body within the block cavity.

4. The reel of claim 3, wherein the adjustment block is adjustable between a stowed position and a deployed position, wherein, in the stowed position, the adjustment block is retained within the block cavity, and wherein, in the deployed position, at least a portion of the adjustment block is outside the block cavity.

5. A reel system comprising:

the reel of claim 1;

a first reel plate; and a second reel plate, wherein the first reel plate and the second reel plate each comprise an outer diameter that is greater than the outer diameter of the reel, and wherein the reel is positioned between the first reel plate and the second reel plate.

6. A cover system comprising the reel of claim 1.

7. A reel for a swimming pool cover system, the reel comprising an adjustable outer diameter configured to receive a rope of the swimming pool cover system and an adjuster configured to selectively change the outer diameter of the reel, the reel further comprising an adjustment system configured to control a position of the adjustment block relative to the reel body, wherein the adjustment system comprises a first adjustment support supported on the reel body, a second adjustment support supported on the adjustment block, and the adjuster engaged with the first adjustment support and the second adjustment support.

8. A reel system comprising:

a reel comprising an adjustable outer diameter configured to receive a rope of a swimming pool cover system and an adjuster configured to selectively change the outer diameter of the reel;

a first reel plate;

a second reel plate, wherein the first reel plate and the second reel plate each comprise an outer diameter that is greater than the outer diameter of the reel, and wherein the reel is positioned between the first reel plate and the second reel plate; and a pivot pin connecting the first reel plate, the adjuster, and the second reel plate, and wherein the adjuster is pivotably supported on the pivot pin.

* * * * *